US009926771B2

(12) United States Patent
O'Brien et al.

(10) Patent No.: US 9,926,771 B2
(45) Date of Patent: Mar. 27, 2018

(54) TUBULAR CONNECTION

(71) Applicant: SCHLUMBERGER TECHNOLOGY CORPORATION, Sugar Land, TX (US)

(72) Inventors: Daniel O'Brien, Stonehaven (GB); Andrew John Joseph Gorrara, Stonehaven (GB)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 408 days.

(21) Appl. No.: 13/928,668

(22) Filed: Jun. 27, 2013

(65) Prior Publication Data

US 2014/0008082 A1 Jan. 9, 2014

(30) Foreign Application Priority Data

Jul. 6, 2012 (GB) ..... GB1212053.1
Jan. 10, 2013 (GB) ..... GB1300442.9

(51) Int. Cl.
*E21B 43/10* (2006.01)
*E21B 17/08* (2006.01)

(52) U.S. Cl.
CPC ..... *E21B 43/106* (2013.01); *E21B 17/08* (2013.01); *E21B 43/103* (2013.01); *E21B 43/108* (2013.01)

(58) Field of Classification Search
CPC ..... E21B 29/00; E21B 29/10; E21B 17/02; E21B 17/08
See application file for complete search history.

(56) References Cited

U.S. PATENT DOCUMENTS 4,593,448 A * 6/1986 Ferrari Aggradi ..... B21D 39/04 138/147
4,648,626 A * 3/1987 Vinciguerra ..... F16L 1/26 285/107
4,662,663 A * 5/1987 Schmitz ..... B21D 39/04 285/382.5

(Continued)

FOREIGN PATENT DOCUMENTS

CN 202266198 6/2012
GB 2345308 A 7/2000

(Continued)

OTHER PUBLICATIONS

EPO As International Search Authority, International Search Report and Written Opinion for PCT/GB2013/051699, dated Nov. 7, 2014, entire document.

(Continued)

*Primary Examiner* — Robert E Fuller

(57) ABSTRACT

Apparatus and method for connecting tubular members in a wellbore. A host tubular member has annular members mounted within a receiving section to provide regions of differing resistance to the radial load. When a portion of a second tubular member is expanded radially outwardly within the receiving section a joint is formed between the members. Embodiments of host tubular members include recesses for the portion to form protrusions within, collapsible rings, channels and valves to expel fluid from the interface between the members and gripper elements and sealing elements to improve the joint.

15 Claims, 4 Drawing Sheets

(56) References Cited

U.S. PATENT DOCUMENTS

| | | | | |
|---|---|---|---|---|
| 4,817,716 | A * | 4/1989 | Taylor | E21B 17/02 166/207 |
| 4,869,319 | A * | 9/1989 | Szymozak | E21B 33/04 166/115 |
| 4,925,220 | A * | 5/1990 | Szymczak | B21D 39/04 285/331 |
| 5,010,952 | A * | 4/1991 | Chin | E21B 33/04 166/206 |
| 6,860,329 | B1 * | 3/2005 | Oosterling | E21B 23/01 166/207 |
| 7,017,670 | B2 | 3/2006 | Hazel et al. | |
| 8,291,986 | B2 | 10/2012 | Gorrara et al. | |
| 2004/0031530 | A1 * | 2/2004 | Duggan | E21B 17/18 138/98 |
| 2004/0159445 | A1 | 8/2004 | Hazel et al. | |
| 2006/0237188 | A1 | 10/2006 | McMahan | |
| 2012/0227984 | A1 | 9/2012 | Thomson | |

FOREIGN PATENT DOCUMENTS

| | | |
|---|---|---|
| GB | 2474692 | 4/2011 |
| WO | WO 01/18354 | 3/2001 |
| WO | WO0216742 A2 | 2/2002 |
| WO | WO 2011/048426 A2 | 4/2011 |

OTHER PUBLICATIONS

Examination Report issued in Australian patent application 2013285209 dated Sep. 23, 2016. 3 pages.

First Office Action issued in Chinese patent application 201380035431.5 dated Jul. 29, 2016. 9 pages.

* cited by examiner

TUBULAR CONNECTION

FIELD OF THE INVENTION

The present invention provides an apparatus and a method for connecting tubular members in a wellbore and in particular provides an apparatus and a method for sealing and/or securing a first (inner) tubular to a second (outer) tubular in a wellbore and thereby providing an annular seal between the first and second tubular members.

BACKGROUND TO THE INVENTION

In wellbore drilling and completion, various tubular elements (also typically referred to in the industry as "tubulars") need to be connected to each other. For example, in well completions, a number of tubulars may have to be connected end to end in order to form a string of tubulars such as a casing string or liner string to line the wellbore to the required depth. In some cases, one tubular has to be set inside another tubular by increasing the diameter of the inner tubular until it contacts the inner wall of the outer tubular and creates an interference fit therewith. The connection between the tubulars very often must be capable of withstanding axial loads (i.e. secured). The connection should also be fluid tight to provide an annular barrier between the tubulars (i.e. sealed) to prevent fluid passage between the internal bore of the outer tubular and the exterior of the inner tubular.

One prior art arrangement for connecting tubular members in a wellbore is described in WO2011/048426 A2 and includes a metal to metal seal between first and second tubular members 1, 2 in a cased wellbore, as shown in FIGS. 1 and 2 of the present application. The second (lower) tubular member 2 includes an upper end portion 21 which has a greater inner diameter than the outer diameter of a lower end portion 11 of the first (upper) tubular member 1. Circumferential recesses or grooves 22 are formed on the inner surface or bore of the upper end portion 21 of the second (lower) tubular member 2. In order to form the seal, firstly, the lower end portion 11 of the first tubular member 1 is located within the upper end portion 21 of the second tubular member 2. Next, a hydraulic expansion tool 3 is lowered from surface inside the first tubular member 1 to the intended location of the seal (see FIG. 2 of the present application). The tool 3 seals off a chamber 7 between a pair of axially spaced apart seals 8. Actuation of the hydraulic expansion tool 3 causes chamber 7 to be filled with fluid under high pressure, and this high pressure fluid acts on the inner surface or bore of the lower end portion 11 of the first tubular member 1 to first elastically and then plastically expand so that the lower end portion 11 expands radially outwardly along a length bounded by the seals 8 into the recesses 22 on the inner bore of the second tubular member 2 such that circumferential protrusions 12 or ridges are formed on the outside of the lower end portion 11 of the first tubular portion 1. These protrusions 12 are received in the recesses 22 until a seal is formed between the first and second tubular members 1, 2.

A similar technique is used to connect an overshot device with a tubular downhole, e.g. casing or liner, in fishing operations, to engage an inner bore surface of the overshot device with the outer surface of the tubular, to allow jarring and retrieval of the tubular.

The problem associated with the above described arrangement is that well fluid present at the interface between the tubular members may become trapped in the recesses which can lead to the formation of hydraulic lock which is potentially damaging to the tubular members and/or means that an effective seal is not formed. In order to exclude fluid, a crushable medium, such as, for example, syntactic foam is sometimes placed into the recesses. In order to place the crushable medium, such as syntactic foam into the recesses, it is necessary to form rings formed from the crushable material which must conform precisely to the shape of the recess. In addition, the circumferential recesses or grooves (into which the crushable rings are inserted) must be preformed or machined and set in the wellbore at a suitable depth prior to any connection being made.

Both manufacturing of the crushable rings and machining of the grooves are difficult and costly and extremely difficult to achieve in tubing having an internal diameter less than 7" (17.5 cm) and, furthermore, it is very difficult to remove the crushable rings if that is required for any reason.

Another type of connection, which addresses the problem of fluid exclusion, is described in EP2013445 B1 and illustrated in FIG. 3 of this present application. In EP2013445 B1, a first (inner) tubular member 4 is expanded into a second (outer) tubular member 5 using the same expansion tool 3 as in FIGS. 1 and 2 which seals off a chamber 7 with axially spaced apart seals 8. The first tubular member 4 has an expandable portion 40 which has a central section 41 and end regions 42. The wall thickness of the central section 41 is relatively uniform and is thinner than the wall thickness of the end regions 42. Tapered portions 43 provide transitional regions between the thinner wall of the central section 41 and the thicker end regions 42. When the tool 3 is actuated, the central section 41 expands prior to the end regions 42 due to the former's thinner sidewall thickness, thereby driving any fluid at the annular interface between the outer surface of the first and the inner surface of the second tubular members 4, 5 in opposite directions axially beyond the end regions 42 into the annular space 9. Seals 6 at the end regions 42 on the outside of the first tubular member 4 provide an additional fluid barrier between the tubular members 4, 5 when the expandable portion 40 has been fully expanded. Since the seals 6 make contact with the second tubular member 5 only after the fluid has been expelled from the interface between the tubular members 4, 5, the occurrence of a hydraulic lock is avoided.

The arrangement of EP2013445B1 suffers from the same drawback as the tubular connection of WO2011/048426 A2 that the tubular members between which the seal connection is made have relatively complicated profiles, particularly the first (inner) tubular member 4 due to its varying sidewall thickness, which results in relatively high manufacturing costs. In addition, the performance of such a connection is limited due to the limited means of modifying the single piece assembly.

Accordingly, the object of the present invention is to provide an expandable tubular connection which is relatively inexpensive to manufacture whilst being capable of providing a reliable hermetic seal and/or being capable of creating a secure connection through which axial force can be transferred and therefore resist relative axial movement occurring. In addition, the object of the present invention is to provide an expandable tubular connection which can be readily adapted to suit different applications.

SUMMARY OF THE INVENTION

According to a first aspect of the invention there is provided an apparatus for connecting tubular members in a wellbore, the apparatus comprising a host tubular member for sealingly connecting with a second tubular member, the host tubular member comprising:— a receiving section adapted to receive therein at least one portion of the second tubular member for permitting expansion of the said at least one portion radially outwardly against the host tubular member until one or more joints are formed between the said at least one portion and the host tubular member;

wherein the host tubular member comprises one or more annular members mounted around the receiving section;

the or each annular member providing resistance to radial load and defining on the receiving section annular regions having differing resistance to the radial load so that upon expansion of the said at least one portion a joint is formed between the said at least one portion and the annular regions of the receiving section.

Preferably, the one or more annular members are mounted around an inner circumference of at least a portion of the axial length of the receiving section of the host tubular member.

Preferably, the one or more created joints are either sealed or secured connections or, more preferably, are both sealed and secured joints. The so formed joint created between the host tubular member and the second tubular member has the ability to withstand axial loads and fluid pressures acting between the host tubular member and the second tubular member. The joint preferably creates both a mechanical fixing between the two tubular members and also a hermetic seal between the host tubular member and the second tubular member. In one arrangement, the receiving section of the host tubular member and the said at least one portion of the second tubular member comprise metallic portions which form a metal-to-metal joint when the said at least one portion of the second tubular member is expanded against the host tubular member. Preferably, the joint is formed as a result of initially elastic and then plastic deformation of the material of at least the said at least one portion and, preferably also the receiving section of the host tubular member.

The outward expansion may be achieved, for example, by application of radial outward pressure or force to side walls of the said at least one portion of the second tubular member within an inner bore of the said at least one portion.

Preferably, the apparatus comprises a fluid exclusion means for excluding fluid from the interface between the said at least one portion of the second tubular member and the receiving section to prevent the occurrence of a hydraulic lock.

Thus, in use, when the said at least one portion of the second tubular member is expanded radially outwardly, the or each annular region of the host tubular member having greater resistance, i.e. a stronger region, resists radial expansion more than the or each region having lower resistance, i.e. a weaker region. Thus, the said at least one portion of the second tubular member expands more at the or each weaker region and less at the or each stronger region and thus provides a hermetic seal and/or a mechanical connection between the said at least one portion and the receiving section.

In one embodiment, the weaker regions alternate with the stronger regions.

In one embodiment, a plurality of annular members are assembled with the receivable portion to define one or more recesses between the annular members in the form of circumferential grooves, the or each recesses providing the weaker regions and the annular members providing the stronger regions. Thus, in use, the said at least one portion of the second tubular members expands into the or each recess to form the joint with the receiving section of the host tubular member. During expansion, a corresponding circumferential protrusion is formed on the exterior of the said at least one portion which enters the respective recess to form the joint with the receiving section. Accordingly, expansion of the said at least one portion results in the said at least one portion having a corrugated profile.

In one embodiment, the fluid exclusion means comprises a fluid exclusion device located in one or more recesses. The fluid exclusion device may be provided having an annular configuration, e.g. in the form of a ring. The fluid exclusion device may comprise a fluid exclusion material, which may comprise a crushable medium, such as, for example closed cell foam, such as, for example, metal foam or syntactic foam, placed in the recess in order to prevent fluid from filling the recess but being collapsible under the pressure of the circumferential protrusion of the said at least one portion so as to allow the protrusion to enter the recess. The fluid exclusion means is also preferably capable of taking in some fluid whilst being collapsed thereby further minimising the risk of occurrence of a hydraulic lock. Such fluid may be present about the fluid exclusion means prior to the fluid exclusion means being collapsed or may be displaced towards the fluid exclusion means during expansion of the said at least one portion of the second tubular member. Alternatively or additionally, the fluid exclusion device comprises a collapsible ring, such as, for example, a hollow ring, in the or each recess, the ring being configured to collapse when the ring experiences certain pressure. The collapsible ring works in a manner similar to the fluid exclusion foam, i.e. by preventing fluid from entering the recess when the ring is intact whilst collapsing under the force of the circumferential protrusion of the said at least one portion of the second tubular member. A collapsible ring can function at higher temperatures and pressures than those withstandable by foam. Also, an appropriately selected collapsible ring may be capable of accommodating greater fluid volume than foam. Further additionally or alternatively, the fluid exclusion device may comprise a valve arranged in the or each recess, the valve being configured to allow fluid to exit the recess when the fluid is subjected to pressure from the circumferential protrusion on the said at least one portion expanding into the recess. In one arrangement, the valve is a one-way valve that allows fluid to escape as the pressure in the recess increases, and is sealed shut by the protrusion on the said at least one portion once the joint with the receiving section has been formed. In one variation, the annular members define one or more inner chambers and the valve is arranged between the or each recess and an adjacent chamber to allow the fluid to migrate into the chamber as the pressure in the recess increases.

The host tubular member preferably further comprises a fastening arrangement on the inner circumference of the receiving section for forming a mechanical connection with the second tubular member. In one variation, the fastening arrangement comprises one or more circumferential anchoring recesses, preferably provided in the form of grooves, in the inner circumference of the receiving section for forming mechanical connection with the second tubular member when one or more corresponding portions of the second tubular member are expanded into the anchoring recesses. This mechanical connection does not need to be fluid tight as it is not required to create a pressure seal with the second tubular member. One or more fluid channels can be provided in the receiving section to channel away fluid from the anchoring recesses during expansion of the portions of the second tubular member in order to provide for greater displacement of the said portions of the second tubular member into the anchoring recess. In one arrangement, the receiving section comprises an annular protrusion on the inner circumference of the receiving section adjacent the anchoring recess and the one or more channels are formed in the annular protrusion (i.e. the annular protrusion is preferably channeled). In one embodiment, the or each channel extends in a substantially axial direction, i.e. substantially lengthwise with respect to the receiving section. Preferably, a number of channels are spaced circumferentially within the annular protrusion. Further preferably, an additional annular recess, preferably a groove, for receiving and accommodating fluid displaced from the anchoring recess via the or each channel is defined in the inner circumference of the receiving section, the additional recess being axially spaced from the anchoring recess and separated from the anchoring recess by the annular protrusion. Preferably, a plurality of such channeled annular protrusions are provided alternating with a corresponding plurality of additional recesses. Further preferably, the additional recess accommodates a fluid exclusion means as described above, such as, for example, a crushable fluid exclusion ring, for minimising the risk of occurrence of a hydraulic lock during expansion of the portions of the second tubular member into the or each anchoring groove by, on the one hand, excluding fluid from the additional recess and, on the other hand, by absorbing, while being compressed, a certain amount of fluid forced into the additional recess via the or each channel from the anchoring recess and/or fluid forced into the additional recess by the expanding portion of the second tubular member from outside the additional recess. The annular protrusions may be provided in the form of annular members as described above, mounted on the inner circumference of the receiving section. Such an arrangement allows the or each corresponding portion of the second tubular member to protrude into the anchoring recess more than in the absence of the channeling. Also, the same level of protrusion as in the absence of the channeling may be maintained, but the receiving section may be provided having higher resistance to pressure.

It will be appreciated that similar channels can indeed be provided in the annular members of the receiving section to channel away fluid from the one or more annular recesses defined between the annular members and thereby to facilitate expansion of the said at least one portion of the second tubular member into the or each recess. In this case, the fluid exclusion means may be provided in some but not all of the recesses, for example, in every second recess, for absorbing a certain amount of fluid forced into the or each recess via the or each channel from an adjacent recess in which a fluid exclusion means is not provided, and/or fluid forced into the recess equipped with the fluid exclusion means by the expanding portion of the second tubular member from outside the additional recess. As with the anchoring recesses, such an arrangement allows the or each corresponding portion of the second tubular member to protrude into the recess more than in the absence of the channelling, or the same level of protrusion may be maintained with the receiving section being provided having higher resistance to pressure.

Alternatively or additionally, the fastening arrangement may comprise annular gripper elements installed on the inner circumference of the receiving section for resisting axial and/or rotational movement of the host tubular member by gripping an outer surface of the second tubular member. The latter arrangement is advantageous as it makes the receiving section even easier to manufacture.

In one embodiment, the host tubular member comprises one or more annular sealing members, which may be provided in the form of sealing rings, e.g. elastomeric, metallic, ceramic or made composite material, on the inner circumferential surface of the receiving section to provide an additional fluid and pressure seal to enhance the sealing performance of the apparatus. The sealing members may alternate in the axial direction with the annular members. Furthermore, the sealing members may be provided with relatively sharp, i.e. not rounded or chamfered, circumferential edges for imparting high contact pressure on the second tubular member.

The apparatus preferably includes a retaining mechanism adapted to hold in place the annular members assembled on the receiving section and potentially to support the second tubular member as it expands. The retaining mechanism may comprise, for example, one or more retaining rings, for example, a pair of retaining rings, one at each end of the receiving section. The retaining rings can be welded, threaded, shrink fit or otherwise secured on the inner circumference of the receiving section. Alternatively or additionally, the or each annular member may be fixed on the host tubular member in a suitable manner, such as, for example, but not limited thereto, via interference fit, welding, threaded connection, or some other method.

Since the annular members of the apparatus of the invention are provided as separate devices assembled around the receiving section of the host tubular member, the host tubular member itself can be weaker, e.g. thinner or softer, than the annular members. Preferably, at least the receiving section of the host tubular member as a whole, i.e. when assembled with the annular members, is stronger than the second tubular member, but again that is not necessarily the case.

The provision of the or each annular member as a separate device mounted on or otherwise fixed to the host tubular member after the host tubular member has been manufactured, makes it possible for the host tubular member or at least the receiving section thereof to have a substantially uniform wall thickness and/or uniform diameter, whether internal or external or both. Thus, the host tubular member can be manufactured more easily and at a lower cost compared to prior art host tubular members. Accordingly, in a preferred embodiment, the host tubular member or at least the receiving section thereof has a uniform wall thickness and/or a uniform diameter whether internal or external or both. It is however envisaged that the host tubular member can nevertheless be profiled. Additionally, the annular members can be manufactured as complete rings rather than split rings, the complete rings being more straightforward to manufacture and providing more reliable sealing. Furthermore, the annular members can be arranged as desired on the host tubular member after the host tubular member has been manufactured, thereby making it possible to vary the configuration of the said at least one portion according to particular technical requirements. Depending on the strength of the second tubular member and sealing requirements, the correct strength of the retaining means can be selected to support the second tubular member as it expands and the correct strength of the host tubular member to resist radial loads can be selected. In the existing designs, both loads must be borne by the same part and therefore large pieces of relatively expensive tubular blanks must be purchased before machining.

Where fluid exclusion foam is used as a fluid exclusion means, complete rings of the foam may be installed eliminating the need to install foam in sections and the need to use adhesive. As a result, space is used more efficiently as there are no cuts in the foam and no gaps between separate sections and, accordingly no allowance is required to accommodate the adhesive. In the existing pre-machined profiles it would be very difficult to install a fluid exclusion component into tubular components having an internal diameter less than 7" (17.5 cm). Furthermore, foam is difficult to remove from integral grooves (due particularly to it being bonded in place) if it is desired to re-use the tubular members because foam has to be machined out and there is a risk that the host tubular member can be scraped or damaged and the foam becomes destroyed completely. Also, in the arrangement of the present invention there is no need for machining as the foam rings can simply be removed and replaced.

It will be appreciated that the host tubular member may comprise one or more sections of pre-machined profiles and one or more sections assembled with the annular members to optimise the performance of the resulting connection. Also, because the receiving section is easier to manufacture than the existing machined arrangements, it is possible to make the receiving section longer than that of the machined arrangement, and thereby to establish a stronger connection. Another advantage of the assembled annular members over integrally formed ones is that the annular members of the present invention can be made much stronger than the host tubular member, thereby making material procurement easier and cheaper. The annular members can be cut from a suitable stock material such as plate, pipe or welded strip.

In one arrangement, the or each annular member comprises a ring or a band. The ring is preferably a complete ring, but may be a split ring.

The or each annular member may be installed by being slid axially inside the host tubular member or by being clamped radially around the inner circumferential surface of the host tubular member.

The or each annular member may be made, for example, from metal, ceramics, elastomeric or composite material. The or each annular member can comprise an assembly of annular sub-members.

The resistance to radial load of the or each stronger and weaker regions can be adjusted by, for example, varying radial thickness or axial length, or the overall size and shape, of the or each annular member, varying axial spacing between each annular member, varying the material of the annular member, providing the or each annular member with other elements influencing the strength of the or each annular member, or a combination of the above.

The said at least one portion of the second tubular member can be expanded by an appropriate tool, such as for example a conventional prior art hydraulic expansion tool, a cone displacement tool, rollers, or any other tool capable of increasing the inner diameter of the said at least one portion.

The host tubular member could be any sort of tubing used downhole, for example, an overshot device for fishing operations, or indeed casing, liner, tieback liner or production tubing, etc. which needs to be fitted over an outer surface of another smaller diameter tubing. Similarly, the second tubular member can comprise any sort of tubing, tubular, conduit or pipe used downhole.

According to a second aspect of the invention there is provided a tubular assembly comprising:— a host tubular member for connecting with a second tubular member, the host tubular member comprising a receiving section adapted to receive therein at least one portion of the second tubular member for expanding the said at least one portion radially outwardly against the host tubular member until one or more sealed joints are formed between the said at least one portion and the host tubular member;

wherein the host tubular member comprises one or more annular members mounted around the receiving section;

the or each annular member providing resistance to radial load and defining on the receiving section annular regions having differing resistance to the radial load so that upon expansion of the said at least one portion a joint is formed between the said at least one portion and the annular regions of the receiving section;

wherein the said at least one portion has been expanded radially outwardly against the receiving section and one or more joints have been formed between the said at least one portion and the receiving section.

According to a third aspect of the invention there is provided a kit of parts including an apparatus for connecting tubular members in a wellbore, the apparatus comprising:— a host tubular member for connecting with a second tubular member, the host tubular member comprising:

a receiving section adapted to receive therein at least one portion of the second tubular member for expanding the said at least one portion radially outwardly against the host tubular member until one or more joints are formed between the said at least one portion and the host tubular member;

wherein the host tubular member comprises one or more annular members mounted around the receiving section;

the or each annular member providing resistance to radial load and defining on the receiving section annular regions having differing resistance to the radial load so that upon expansion of the said at least one portion a joint is formed between the said at least one portion and the annular regions of the receiving section; and the second tubular member to be connected with the host tubular member.

According to a fourth aspect of the invention there is provided a method of manufacturing an apparatus for connecting tubular members in a wellbore, the method comprising the steps of (a) providing a host tubular member for connecting with a second tubular member, the host tubular member comprising:

a receiving section adapted to receive therein at least one portion of the second tubular member for expanding the said at least one portion radially outwardly against the host tubular member until one or more joints are formed between the said at least one portion and the host tubular member;

(b) mounting one or more annular members around the receiving section;

the or each annular member providing resistance to radial load and defining on the receiving section annular regions having differing resistance to the radial load so that upon expansion of the said at least one portion a joint is formed between the said at least one portion and the annular regions of the receiving section.

Preferably, the method includes mounting the annular members on an inner circumferential surface of the receiving section by sliding the annual member axially into the receiving section and retaining the annular members in place inside the receiving section.

According to a fifth aspect of the invention there is provided a method of connecting tubular members in a wellbore, the method comprising the steps of:—

(a) providing a host tubular member for connecting with a second tubular member, the host tubular member comprising:

a receiving section adapted to receive therein at least one portion of the second tubular member and one or more annular members mounted around the receiving section; the or each annular member providing resistance to radial load and defining on the receiving section annular regions having differing resistance to the radial load (b) placing the said at least one portion within the receiving section of the host tubular member so that upon expansion of the said at least one portion in order to form a joint between the portion; and (c) expanding the said at least one portion radially outwardly against the receiving section until one or more joints are formed between the said at least one portion and the annular regions of the receiving section of the host tubular member.

All essential, preferred or optional features of the first aspect of the present invention can be provided in conjunction with one or more of the second, third, fourth and fifth aspects of the present invention and vice versa where appropriate.

DETAILED DESCRIPTION OF THE INVENTION

Embodiments of the present invention will now be described, by way of example only, with reference to the accompanying drawings in which.

Figure 4:
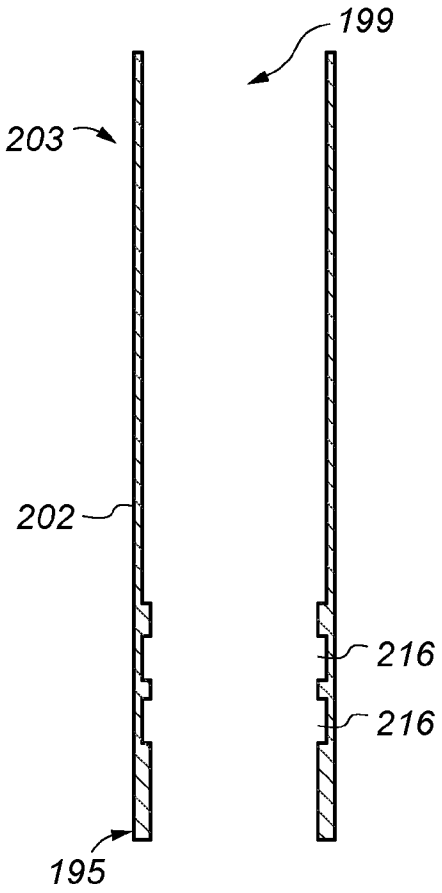
FIG. 4 is a schematic sectional side view of a host tubular member of an apparatus for connecting tubular members according to the present invention.
Figure 6:
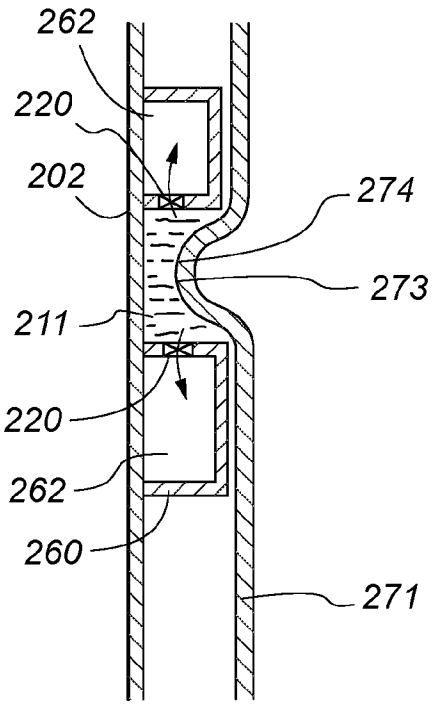
Figure 5:
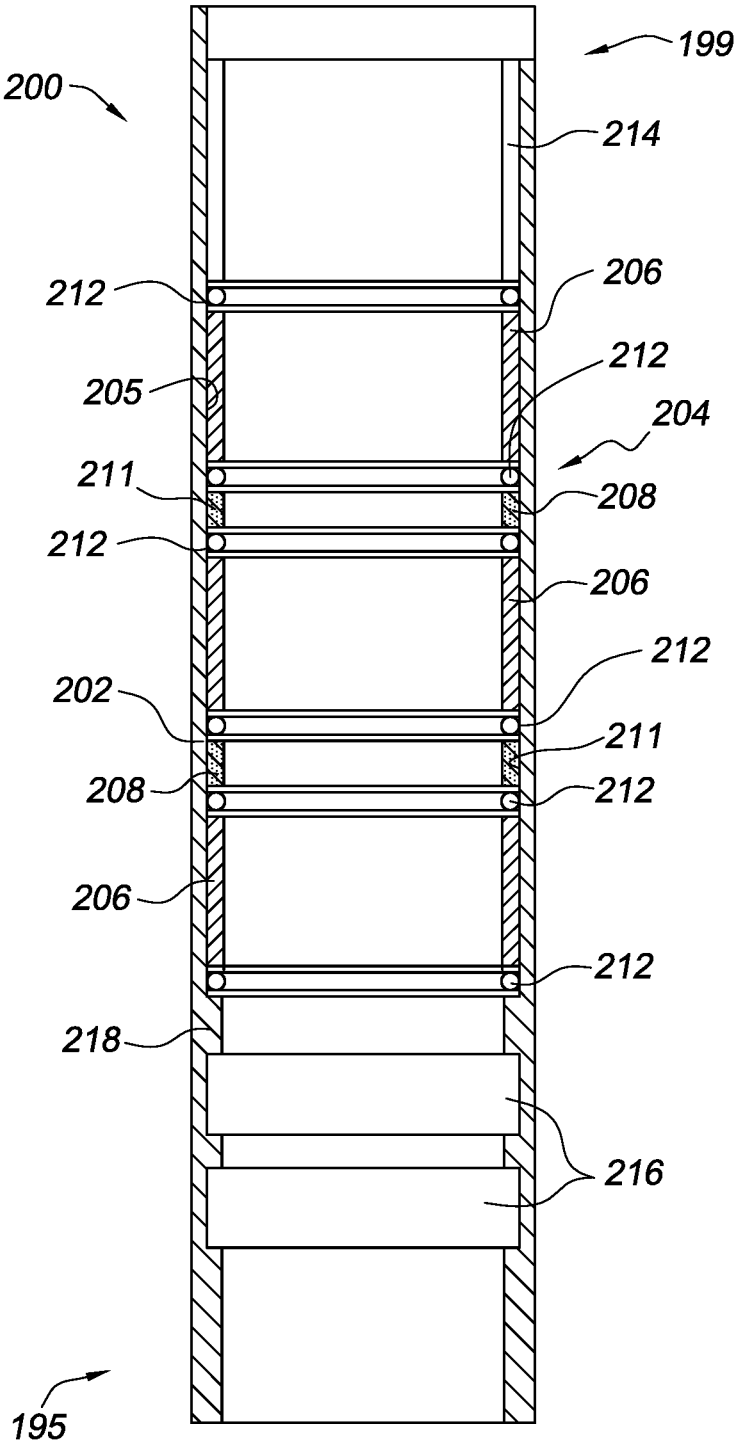
Figure 7:
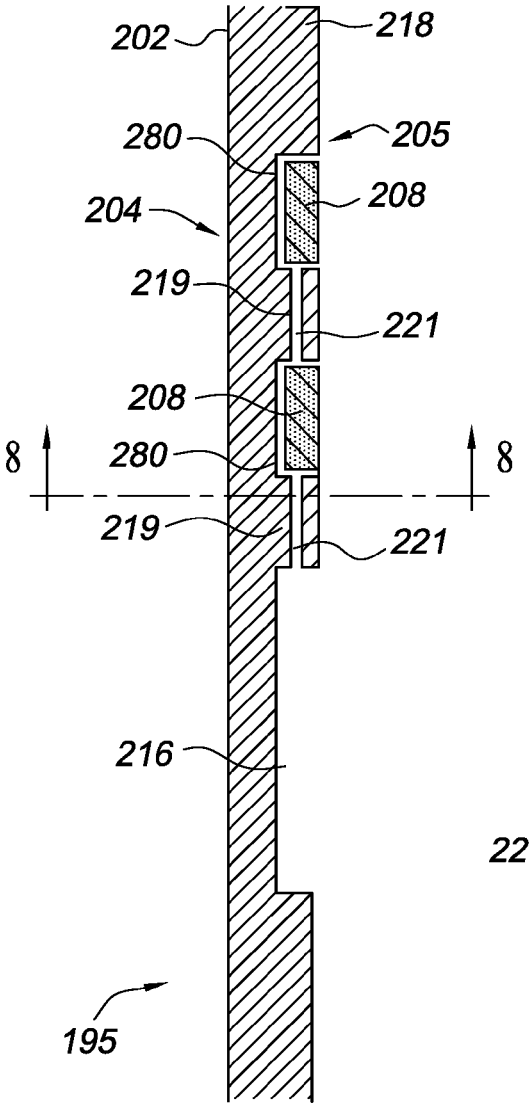

FIG. 5 is a schematic sectional side view of the host tubular member of FIG. 4 after it has been assembled with internal annular members; and FIG. 6 is a schematic partial sectional side view of a fluid exclusion arrangement for use with the apparatus of FIG. 4 in accordance with the present invention; and FIG. 7 is a schematic partial sectional side view of a further fluid exclusion arrangement for use with the apparatus of FIG. 4 in accordance with the present invention.

Figure 8:
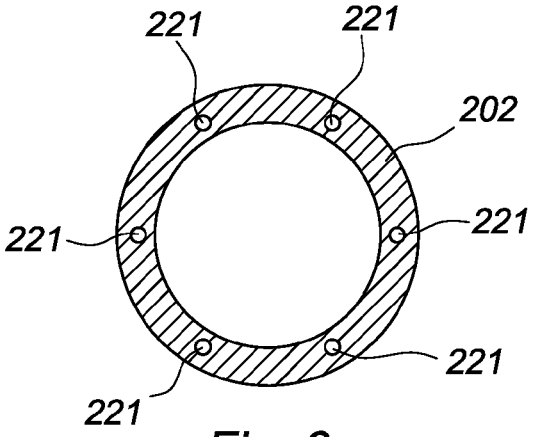

FIG. 8 is a cross section view across a horizontal plane of FIG. 7.

Figure 3:
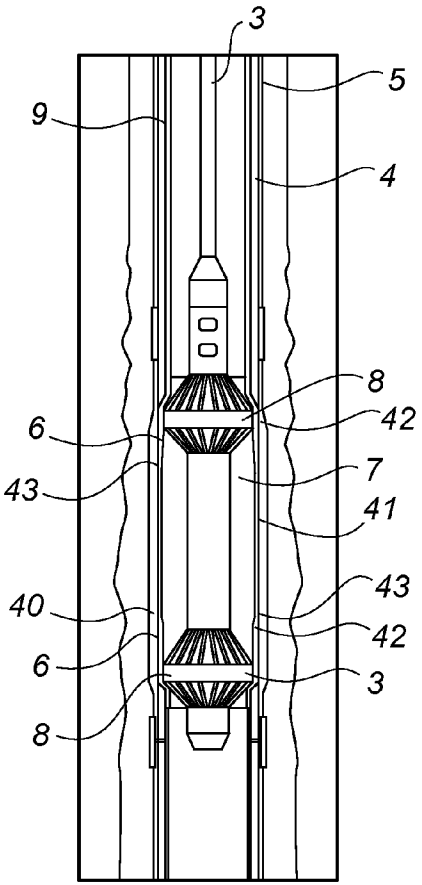
Fig. 3 (PRIOR ART)
FIG. 3 is a sectional side view of a further prior art method of connecting tubular members and therefore does not form part of the present invention.
Figure 2:
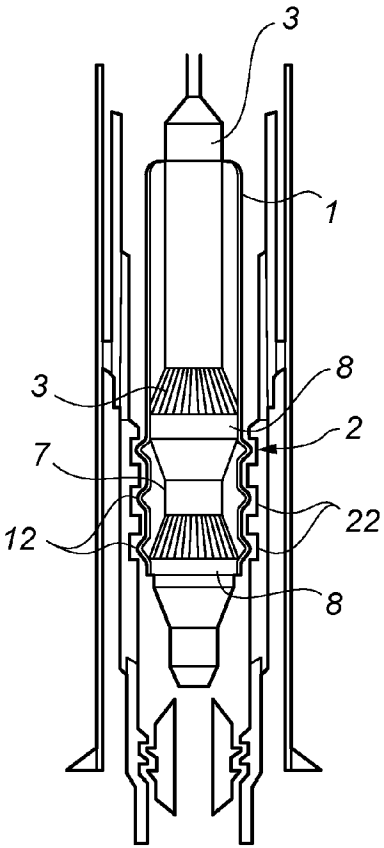
Fig. 2 (PRIOR ART)
FIGS. 1 and 2 are sectional side views of stages of a prior art method of connecting tubular members and therefore do not form part of the present invention.
Figure 1:
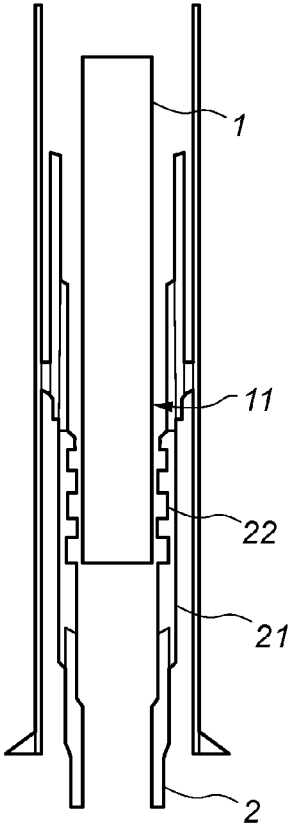
Fig. 1 (PRIOR ART)

Referring initially to FIG. 5 an apparatus for connecting tubular members in a wellbore in accordance with the aspects of the present invention is indicated generally by reference numeral 200. The apparatus 200 comprises a host tubular member 202 for connecting with a second tubular member (not shown in FIG. 5 but which is similar to the inner tubular member 1 shown in FIGS. 1 and 2 and which is seen in FIG. 6 as tubular 271 during or post expansion). The host tubular member 202 comprises a receiving section 204 adapted to receive therein portions 273 of the second tubular member 271, which is expanded radially outwardly by application of radial outward pressure or force to side walls of the portion 273 and more particularly by applying high pressure fluid to an inner bore of the portion 273 using an expansion tool, such as for example a prior art tool 3 shown in FIG. 2 or FIG. 3. As a result, the expandable portion 273 expands against an inner circumferential surface 205 of the host tubular member 202 and forms a joint (not shown) between the portion 273 and the host tubular member 202. The joint formed between the portion 273 and the host tubular member 202 provides both a fluid tight seal and a mechanical connection between the host tubular member 202 and the second tubular member. Although only one portion 273 is shown in FIG. 6 being expanded against the inner circumferential surface 205 of the host tubular member 202, a number of such portions are formed on the second tubular member 271 in the presently described embodiments. Other tools, such as a cone displacement tool, rollers, or any other tool capable of increasing the inner diameter of the portion 273 can in principle be used.

As shown in FIG. 4, the host tubular member 202 comprises a hollow body 203 having relatively thin walls of uniform thickness. On assembly of the apparatus 200, a plurality of annular members in the form of resistance rings 206 are slid into and along the inner bore of the receiving section 204 from the largest inner diameter end (the upper most end 199 shown in FIG. 4) until they are mounted around the inner circumferential surface 205 of the receiving section 204 and spaced along the receiving section 204 to define recesses 211. The rings 206 and the recesses 211 define annular regions having differing resistance to radial load for permitting expansion of the respective portions 273 for forming joints between the portions 273 and the annular regions of the receiving section 204. The resistance rings 206 are preferably complete rings, but may be split rings.

Since the resistance rings 206 are provided as separate devices assembled with the receiving section 204 of the host tubular member 202, the body 203 of the host tubular member 202 can be weaker, e.g. thinner or softer, than the resistance rings 206. However, at least the receiving section 204 of the host tubular member 202 as a whole, i.e. when assembled with the resistance rings 206, is stronger than the second tubular member 271. The resistance rings 206 can be made, for example, from metal, ceramics, elastomeric or composite material. The resistance rings 206 can also comprise an assembly of annular sub-members.

The apparatus 200 also comprises a fluid exclusion means for excluding fluid from the interface between the portions 273 and the receiving section 204 to prevent the occurrence of a hydraulic lock. In the presently described embodiment, the fluid exclusion means comprises fluid exclusion rings 208 made from a fluid exclusion material, such as, for example closed cell foam, such as, for example, metal foam or syntactic foam. The fluid exclusion rings 208 are placed in the respective recesses 211 in order to prevent fluid from entering the recess 211. The fluid exclusion rings 208 are crushable or collapsible under external pressure. The fluid exclusion rings are preferably capable of taking in some fluid whilst being collapsed thereby further minimising the risk of occurrence of a hydraulic lock. Such fluid may be present around the fluid exclusion rings 208 prior to the fluid exclusion rings 208 being collapsed or may be displaced towards the fluid exclusion rings 208 during expansion of the respective portions 273 of the second tubular member 271. The resistance rings 206 and the fluid exclusion rings 208 form on the inner circumferential surface of the receiving section 204 regions having alternating stronger and weaker resistance to radial loads. The resistance rings 206 resist the radial outward expansion of the expandable portion more than the fluid exclusion rings 208 with the result that the resistance rings 206 may not deform at all whereas the fluid exclusion rings 208 will become compressed and crushed by portions 273 of the second tubular member 271. During expansion, a circumferential protrusion 274 is formed on the exterior of the portion 273 which compresses and crushes the fluid exclusion ring 208 and thereby enters the respective recess 211 to thereby form a joint with the receiving section 204. Accordingly, expansion of the portions 273 results in that a length of the second tubular member 271 acquires a corrugated profile (as can be seen in FIG. 6). In this manner, both a) a hermetic seal and b) a mechanical connection are created between the expandable portions 273 and the receiving section 204.

The so formed joint between the host tubular member 202 and the second tubular member 271 has the ability to withstand axial loads and fluid pressures acting between the host tubular member 202 and the second tubular member 271. The joint creates both a mechanical fixing between the two tubular members 202, 271 and also a hermetic seal between the host tubular member 202 and the second tubular member 271. The receiving section 204 of the host tubular member 202 and the second tubular member 271 may be made from metal or at least comprises metallic portions which form a metal-to-metal sealed joint when the portion 273 is expanded against the host tubular member 202. The joint is formed as a result of initially elastic and then plastic deformation of the material of the portion 273 and possibly the receiving section 204 of the host tubular member 202.

The fluid exclusion rings 208 preferably comprise complete rings, but may be split rings.

Still referring to FIG. 5, the host tubular member 202 comprises a fastening arrangement provided in the form of circumferential anchoring recesses provided on the form of anchoring grooves 216 in the inner circumferential surface 205 of the receiving section 204 for forming a mechanical connection with the second tubular member 271 when one or more corresponding portions (not shown) of the second tubular member 271 are expanded into the anchoring grooves 216. This mechanical connection does not need to be fluid tight as it is not required to create a pressure seal with the second tubular member 271. Alternatively or additionally, although not shown in the drawings, the fastening arrangement may comprise annular gripper elements installed on the inner circumference of the receiving section 204 for resisting axial and/or rotational movement of the host tubular member 202 by gripping an outer surface of the second tubular member 271. The latter arrangement is advantageous as it makes the receiving section 204 even easier to manufacture.

The host tubular member 202 further comprises a plurality of annular sealing members provided in the form of sealing rings 212 which may be made from a suitable material having properties advantageous for sealing with the metal second tubular member 271 such as elastomeric, metallic or ceramic composite material. The sealing rings 212 are installed on the inner circumferential surface 205 of the receiving section 204 to provide an additional fluid and pressure seal to enhance the sealing performance of the apparatus 200. The sealing rings 212 alternate in the axial direction with the resistance rings 206 and the fluid exclusion rings 208. Although not shown in the drawings, the sealing rings 212 may be provided with relatively sharp, i.e. not rounded or chamfered, circumferential edges for imparting high contact pressure on the second tubular member 271.

A retaining mechanism is provided in the receiving section 204 for holding in place the resistance rings 206, the fluid exclusion rings 208 and the sealing rings 212 installed in the receiving section 204 and to support the second tubular member 271 as it expands. In the presently described embodiment, the retaining mechanism comprises a retaining ring 214 at one end (the upper most end 199 shown in FIG. 5) of the receiving section 204 and a ledge 218 on the inner circumference at the other end (the lower most end 195 shown in FIG. 5) of the receiving section 204. The retaining ring 214 can be welded, threaded, shrink fit or otherwise secured on the inner circumference of the receiving section 204. Alternatively or additionally, the resistance rings 206 may be fixed to the inner circumference of the receiving section 204 via interference fit, welding, threaded connection, or some other suitable method.

FIG. 6 shows an alternative or additional variation of fluid exclusion means. In the variation of FIG. 6, the annular members of the receiving section 204 are provided in the form of hollow resistance rings 260 which function essentially in the same manner as the resistance rings 206 of FIG. 5, but additionally have respective inner chambers 262 for receiving and containing fluid from the adjacent recesses 211. Respective valves 220 are arranged between a recess 211 and a respective chamber 262 in an adjacent resistance ring 260 to allow fluid to migrate from the recess 211 into the chamber 262 as the pressure in the recess 211 increases when the fluid is subjected to pressure from a circumferential protrusion 274 on the portion 273 expanding into the recess 211. The valves 220 may be one-way valves that allow fluid to escape as the pressure in the recess 211 increases, and become sealed shut by the protrusion 274 on the portion 273 once the joint with the receiving section 204 has been formed.

As shown in FIG. 7, in one embodiment, fluid channels 221 are provided in the receiving section 204 to channel away fluid from the anchoring grooves 216 during expansion of portions of the second tubular member 271 (not shown in FIG. 7) into the anchoring grooves 216 in order to provide for greater displacement of the said portions of the second tubular member 271 into the anchoring grooves 216. More specifically, the receiving section 204 comprises annular protrusions 219 on the inner circumference 205 of the receiving section 204 adjacent the anchoring recess 216 and the channels 221 are formed in the annular protrusions 219. The channels 221 extend in a substantially axial direction, i.e. substantially lengthwise with respect to the receiving section 204, and are spaced circumferentially within each protrusion 219. Additional annular recesses provided in the form of grooves 280 are defined in the inner circumference 205 of the receiving section 204 for receiving and accommodating fluid displaced from the anchoring grooves 216 via the or each channel 221. The additional grooves 280 are axially spaced from the anchoring grooves 216 and separated from the anchoring grooves 216 by the annular protrusions 219, and the annular protrusions 219 alternate with the additional grooves 280. The additional grooves 280 accommodate fluid exclusion rings 208 similar to those shown in FIG. 5 for minimising the risk of occurrence of a hydraulic lock during expansion of the portions of the second tubular member 271 into the anchoring grooves 216 by, on the one hand, excluding fluid from additional grooves 280 and, on the other hand, by absorbing, while being compressed, a certain amount of fluid forced into the additional grooves 280 via the channels 221 from the anchoring grooves 216 and/or fluid forced into the additional grooves 280 by the expanding portions of the second tubular member 271 from outside the additional grooves (i.e. from an annular space between an outer surface of the second tubular member 271 and the inner surface 205 of the host tubular member 202). Although not shown in the drawings, the annular protrusions may be provided in the form of removable rings, such as resistance rings 206 as described above, mounted on the inner circumference 205 of the receiving section 204. This arrangement allows the portions of the second tubular member 271 to protrude into the anchoring grooves 216 more than in the absence of the channels 221 and the additional grooves 280. Also, the same level of protrusion as in the absence of the channels 221 and the additional grooves 280 may be maintained, but the receiving section 204 may be provided having higher resistance to pressure.

FIG. 8 is a cross section view across a horizontal plane of FIG. 7.

Although not shown in the drawings, channels similar to channels 221 can be provided in the resistance rings 206 of the receiving section 204 to channel away fluid from the one or more annular recesses 211 defined between the resistance rings 206 and thereby to facilitate expansion of the portion 273 of the second tubular member 271 into the annular recesses 211. The fluid exclusion rings 208 may be provided in some but not all of the annular recesses 211, for example, in every second annular recess 211, for absorbing upon compression a certain amount of fluid forced into that annular recess 211 via the channels from an adjacent recess 211 in which a fluid exclusion ring 206 is not provided, and/or fluid forced into the annular recess 211 equipped with a fluid exclusion ring 206 by the expanding portion 273 of the second tubular member 271 from an annular space between an outer surface of the second tubular member 271 and the inner surface 205 of the host tubular member 202. Accordingly, the portions 273 of the second tubular member 271 can protrude into the annular recess 211 more than in the absence of the channels, or the same level of protrusion may be maintained with the receiving section 204 being provided having higher resistance to pressure.

In another variation not shown in the drawings, the fluid exclusion means comprises a collapsible ring, such as, for example, a hollow ring, in the or each recess 211. The hollow ring is configured to collapse when the ring experiences certain pressure. The collapsible ring works in a manner similar to the fluid exclusion foam, i.e. by preventing fluid from entering the recess 211 when the hollow ring is intact whilst collapsing under the force of the circumferential protrusion 274 of the portion 273. A collapsible ring may be able to function at higher temperatures and pressures than those withstandable by fluid exclusion foam. Also, an appropriately selected collapsible ring may be capable of accommodating greater fluid volume than fluid exclusion foam. Also, an appropriately selected collapsible ring may be capable of accommodating greater fluid volume than fluid exclusion foam. The collapsible rings may be used instead of the foam rings 208 in conjunction with the channelling described above.

The resistance rings 206, the fluid exclusion rings 208, the sealing rings 212 and the retaining rings 214 are easily assembled with the host tubular member 202 by being slid axially one after the other in the eventually desired order inside the host tubular member 202 from one end 199 thereof, and specifically, from the end 199 opposite the end with the shoulder 218 (the said one end 199 being the upper most end as shown in FIG. 5) and can be easily removed via the said end 199 in the reverse order if required and replaced.

The host tubular member 202 could be any sort of tubing used downhole, for example, an overshot device for fishing operations, or indeed casing, liner, tieback liner or production tubing, etc. which needs to be fitted over an outer surface of another smaller diameter tubing 271. Similarly, the second tubular member 271 can comprise any sort of tubing or pipe used downhole or even any tubular that hitherto has not been used downhole.

Whilst specific embodiments of the present invention have been described above, it will be appreciated that modifications are possible within the scope of the present invention.

We claim:

1. An apparatus for connecting tubular members in a wellbore, the apparatus comprising:

a host tubular member for sealingly connecting with a second tubular member positioned within said host tubular member, the host tubular member comprising:— a receiving section adapted to receive therein at least one portion of the second tubular member while said second tubular member is supported from above for permitting expansion of the at least one portion of said second tubular member radially outwardly against the host tubular member until one or more joints are formed between the said at least one portion of said second tubular member and the host tubular member;

wherein the host tubular member comprises one or more annular members mounted around the receiving section and disposed on an inner circumferential surface of said host tubular member;

the one or more annular members providing resistance to radial load, and defining on the receiving section annular regions having differing resistance to the radial load, so that upon expansion of the at least one portion of said second tubular member against an inner circumferential surface within said annular regions of said host tubular member, a joint is formed between the at least one portion of said second tubular member and the annular regions of the receiving section of said host tubular member, wherein the host tubular member further comprises a fastening arrangement on the inner circumference of the receiving section for forming a mechanical connection with the second tubular member, the fastening arrangement comprising one or more circumferential anchoring recesses being grooves in the inner circumference of the receiving section, wherein one or more fluid channels are provided in the receiving section to channel away fluid from the anchoring recesses during expansion of the portions of the second tubular member and wherein the receiving section comprises an annular protrusion on the inner circumference of the receiving section adjacent the anchoring recess and the one or more channels are formed in the annular protrusion.

2. The apparatus according to claim 1 wherein the one or more annular members comprises a plurality of annular members separate from said host tubular member, and wherein the plurality of annular members are assembled within the receiving section of said host tubular member to define one or more recesses between the annular members in the form of circumferential grooves within said host tubular member, the one or more recesses providing weaker resistance regions and the annular members providing stronger resistance regions.

3. The apparatus according to claim 2 wherein the apparatus comprises a fluid exclusion device for excluding fluid from an interface between the at least one portion of the second tubular member and the receiving section to prevent the occurrence of a hydraulic lock.

4. The apparatus according to claim 3 wherein the fluid exclusion device is located in one or more recesses.

5. The apparatus according to claim 4 wherein the fluid exclusion device comprises a fluid exclusion material selected from a group comprising: closed cell foam, metal foam and syntactic foam.

6. The apparatus according to claim 4 wherein the fluid exclusion device comprises a hollow collapsible ring.

7. The apparatus according to claim 1 wherein an additional annular recess for receiving and accommodating fluid displaced from the anchoring recess via the one or more channels is defined in the inner circumference of the receiving section, the additional recess being axially spaced from the anchoring recess and separated from the anchoring recess by the annular protrusion.

8. A method of connecting tubular members in a wellbore, the method comprising the steps of:

(a) providing a host tubular member for connecting with a second tubular member lowered into and disposed within said host tubular member, the host tubular member comprising:

a receiving section adapted to receive therein at least one portion of the second tubular member and one or more annular members mounted around an inner circumferential surface of the receiving section; the one or more annular members providing resistance to radial load and defining on the receiving section annular regions having differing resistance to the radial load;

(b) lowering into and placing the at least one portion of said second tubular member within the receiving section of the host tubular member; and (c) expanding the at least one portion of said second tubular member radially outwardly against said inner circumferential surface of the receiving section of said host tubular member until one or more joints are formed between the at least one portion of said second tubular member and the annular regions of the receiving section of the host tubular member, wherein step (c) includes causing fluid to be continuously expelled from an interface between the portion of the second tubular member and the receiving section as the portion expands and channeling fluid from the interface through one or more channels in an annular member on the receiving section.

9. The method according to claim 8 wherein the method further comprises the step of withstanding axial loads and fluid pressures acting between the host tubular member and the second tubular member.

10. The method according to claim 8 wherein the method includes the step of initially elastically and then plastically deforming the material of the at least one portion.

11. The method according to claim 10 wherein the method includes the step of elastically deforming the material of the host tubular member.

12. The method according to claim 8 wherein step (a) includes locating a collapsible ring within a recess formed between annular members and step (c) includes preventing fluid from entering the recess by the action of the ring and collapsing the ring on pressure from a protrusion.

13. The method according to claim 12 wherein step (c) includes absorbing fluid in the ring.

14. An apparatus for connecting tubular members in a wellbore, the apparatus comprising a host tubular member for sealingly connecting with a second tubular member, the host tubular member comprising:

a receiving section adapted to receive therein at least one portion of the second tubular member for permitting expansion of the at least one portion radially outwardly against the host tubular member until one or more joints are formed between the said at least one portion and the host tubular member;

one or more annular members mounted around the receiving section, the or each annular member providing resistance to radial load and defining on the receiving section annular regions having differing resistance to the radial load so that upon expansion of the said at least one portion a joint is formed between the said at least one portion and the annular regions of the receiving section;

wherein the host tubular member further comprises a fastening arrangement on the inner circumference of the receiving section for forming a mechanical connection with the second tubular member, the fastening arrangement comprising one or more circumferential anchoring recesses being grooves in the inner circumference of the receiving section, wherein one or more fluid channels are provided in the receiving section to channel away fluid from the anchoring recesses during expansion of the portions of the second tubular member and wherein the receiving section comprises an annular protrusion on the inner circumference of the receiving section adjacent the anchoring recess and the one or more channels are formed in the annular protrusion.

15. The apparatus according to claim 14 wherein an additional annular recess for receiving and accommodating fluid displaced from the anchoring recess via the one or more channels is defined in the inner circumference of the receiving section, the additional recess being axially spaced from the anchoring recess and separated from the anchoring recess by the annular protrusion.

* * * * *